US005327148A

United States Patent [19]

How et al.

[11] Patent Number: 5,327,148

[45] Date of Patent: Jul. 5, 1994

[54] FERRITE MICROSTRIP ANTENNA

[75] Inventors: Hoton How, Malden; Carmine Vittoria, Boston, both of Mass.

[73] Assignee: Northeastern University, Boston, Mass.

[21] Appl. No.: 18,942

[22] Filed: Feb. 17, 1993

[51] Int. Cl.[5] ..... H01Q 1/38; H01Q 1/00

[52] U.S. Cl. ..... 343/700 MS; 343/787

[58] Field of Search ..... 343/700 MS, 787, 829, 343/846, 848; H01Q 1/38, 1/00

[56] References Cited

U.S. PATENT DOCUMENTS

| | | | |
|---|---|---|---|
| 3,716,854 | 2/1973 | Charlot, Jr. | 343/5 PD |
| 3,811,128 | 5/1974 | Munson | 343/787 |
| 3,924,204 | 12/1975 | Fasche et al. | 333/21 R |
| 4,001,834 | 1/1977 | Smith | 343/754 |
| 4,117,494 | 9/1978 | Frazita | 343/844 |
| 4,241,352 | 12/1980 | Alspaugh et al. | 343/700 MS |
| 4,254,383 | 3/1981 | Wolfe | 333/164 |
| 4,857,840 | 8/1989 | Lanchais | 324/207 |
| 4,879,562 | 11/1989 | Stern et al. | 343/700 MS |
| 4,881,052 | 11/1989 | Stern et al. | 333/24.1 |
| 4,887,054 | 12/1989 | Stern et al. | 333/158 |
| 4,933,680 | 6/1990 | Shapiro et al. | 343/700 MS |
| 5,014,070 | 5/1991 | Stock et al. | 343/700 MS |
| 5,057,106 | 10/1991 | Kasevich et al. | 606/33 |
| 5,111,211 | 5/1992 | Dahlberg | 343/700 MS |

OTHER PUBLICATIONS

Fay, C. E., "Operation of the Ferrite Junction Circulator", IEEE Transactions, on Microwave Theory & Techniques, (no month) 1965, pp, 15-27.

Derneryd, Anders G., "A Theoretical Investigation of the Rectangular Microstrip Antenna Element", IEEE Transactions on Antennas and Propagation vol. AP-26 No. 4. Jul. 1978, pp. 532-535.

Lo, Y. T., "Theory and Experiment on Microstrip Antennas", IEEE Transactions and Propagation, vol. 27, Mar. 1979, 137-145.

Rana, Inam E., "Current Distribution and Input Impedance of Printed Dipoles", IEEE Transactions on Antennas and Propagation, vol. AP-29, No. 1, Jan. 1981, pp. 99-105.

How, H., "Novel Filter Design Incorporation Asymmetrical Stripline Y-Junction Circulators", IEEE Transactions on Microwave Theory and Techniques, vol. 39, No. 1, Jan. 1991, pp. 40-46.

Pozar, David M., "RCS Reduction for a Microstrip Antenna Using a Normally Biased Ferrite Substrate", IEEE Microwave and Guided Wave Letters, vol. 2, No. 5, 1992, pp. 192-198.

Pozar, D. M., "Magnetic Tuning of a Microstrip Antenna on a Ferrite Substrate," Electron. Lett., vol. 24, Jun. 9, 1988, pp. 729-731.

Shen, L. C., "Resonant Frequency of a Circular Disc, Printed Circuit Antenna," IEEE Transactions on Antennas and Propagation, Jul. 1977, pp. 595-596.

Watkins, J. "Circular Resonant Structures in Microstrip," Electronic Letters, vol. 5, No. 21, Oct. 1969 pp. 524.

*Primary Examiner*—Donald Hajec
*Assistant Examiner*—Hoanganh Le
*Attorney, Agent, or Firm*—Weingarten, Schurgin, Gagnebin & Hayes

[57] ABSTRACT

A microstrip antenna includes a ferrite loaded substrate having a ground plane conductor disposed over a first surface thereof and having a strip conductor disposed over a second surface thereof. A DC magnetic field biasing circuit provides a directed DC magnetic field to the ferrite substrate such that the strip conductor radiates electromagnetic energy having circular polarization. In one embodiment, a ferrite material is disposed over the strip conductor to reduce the radar cross section of the antenna.

21 Claims, 4 Drawing Sheets

FERRITE MICROSTRIP ANTENNA

FIELD OF THE INVENTION

This invention relates to radio frequency antennas and more particularly to microstrip radio frequency antennas.

BACKGROUND OF THE INVENTION

As is known in the art, a microstrip antenna typically includes a substrate having a ground plane disposed on a first surface thereof and a radiating element provided as a strip conductor having a rectangular or circular shape disposed on a second surface thereof. Radio frequency (RF) energy is typically coupled to the radiator via an RF feed circuit. When a single RF feed circuit is coupled to a radiating element having a rectangular shape, the antenna radiates electromagnetic energy having a linear polarization.

As is also known, there has been a trend in microstrip antennas to provide the substrate as a ferrite substrate and provide a DC magnetic field perpendicular to the plane in which the radiating element is disposed. This is done to provide the antenna having phase shifting, impedance matching and frequency tuning capabilities. For example, by applying a DC magnetic field to a microstrip antenna array having a plurality of radiating elements disposed over a ferrite substrate, a so-called main antenna beam of the antenna may be scanned and the radiation frequency of a microstrip antenna may be tuned by varying the strength of the biasing magnetic field.

One problem with such rectangular shaped radiating elements having a single feed however, is that they are linearly polarized. In many applications, it would be desirable to be able to receive RF energy of any polarization, and in particular it would be desirable to receive RF energy having two orthogonal polarizations or circular polarizations.

Microstrip antennas having circular polarization are able to receive RF energy having any polarization. Conventional circularly polarized microstrip antennas include a radiating element having a circular shape and a single feed circuit (i.e., single feed circular patch). Alternatively, a radiating element having a rectangular shape fed from two properly phased feed circuits coupled to adjacent sides of the radiating element (i.e., dual feed rectangular patch) may also provide circular polarization. In the single feed circular patch approach, the amount of elipticity in the shape of the radiating element determines the mixing of the two orthogonal linearly polarized radiations which in turn provides the circularly polarized waves.

In the dual feed rectangular patch approach, two orthogonal feeds are required in which the relative phases are shifted 90° apart from each other to provide an antenna which may radiate electromagnetic energy having circular polarization.

SUMMARY OF THE INVENTION

Thus it would be desirable to provide a microstrip antenna having a rectangular shape and a single feed and which is capable of receiving and transmitting circularly polarized RF energy. In accordance with the present invention, a microstrip antenna includes a ferrite loaded substrate having first and second opposing surfaces and a predetermined thickness, a ground plane conductor disposed over the first surface of the substrate, a first strip conductor disposed over a second surface of the substrate, and an RF feed circuit disposed on a first one of the first and second surfaces of the substrate and coupled to the first strip conductor. A DC magnetic field biasing circuit, coupled to the antenna, provides a DC magnetic field having a predetermined strength to the ferrite substrate. The DC magnetic field may be provided in a plane parallel to a plane in which the ferrite substrate is disposed and perpendicular to the RF feed circuit. With this particular arrangement, a microstrip antenna having a rectangular shape and a single feed line and which is responsive to electromagnetic energy having circular polarization is provided. By selecting a DC magnetic field having a predetermined strength and providing the DC magnetic field parallel to the plane in which the substrate is disposed and perpendicular to the feed circuit, the rectangular shaped antenna may transmit and receive circularly polarized electro-magnetic signals without having two orthogonally disposed RF feed circuits coupled thereto. Thus, circular polarization may be provided from the rectangular shaped microstrip antenna having the single RF feed circuit.

In accordance with a further aspect of the present invention, a microstrip antenna includes a ferrite loaded substrate having first and second opposing surfaces, a ground plane conductor disposed over the first surface of substrate, and a first strip conductor disposed over a second surface of the substrate wherein the first strip conductor is provided having a shape selected such that the first strip conductor is responsive to electromagnetic energy at a first frequency. The antenna further includes an RF feed circuit disposed on a first one of the first and second surfaces of the substrate and coupled to the first strip conductor, a ferrite material disposed over the strip conductor. The ferrite material is selected having a permeability selected to provide the antenna having a low radar cross section at a predetermined frequency. A DC magnetic field biasing circuit provides a DC magnetic field in a direction normal to the ferrite substrate and the first strip conductor. With this particular arrangement, an antenna having a relatively wide operating frequency bandwidth and minimized radar cross section is provided. By selecting the permeabilities of the first and second ferrite materials such that the ferromagnetic resonance (FMR) of the second ferrite is provided at a particular frequency within the operating frequency band of the antenna, signals received at that frequency are absorbed by the second ferrite and thus the antenna is provided having a reduced radar cross section.

BRIEF DESCRIPTION OF THE DRAWINGS

The foregoing features of this invention as well as the invention itself may be more fully understood from the following detailed description of the drawings in which.

DESCRIPTION OF THE PREFERRED EMBODIMENTS

Figure 1:
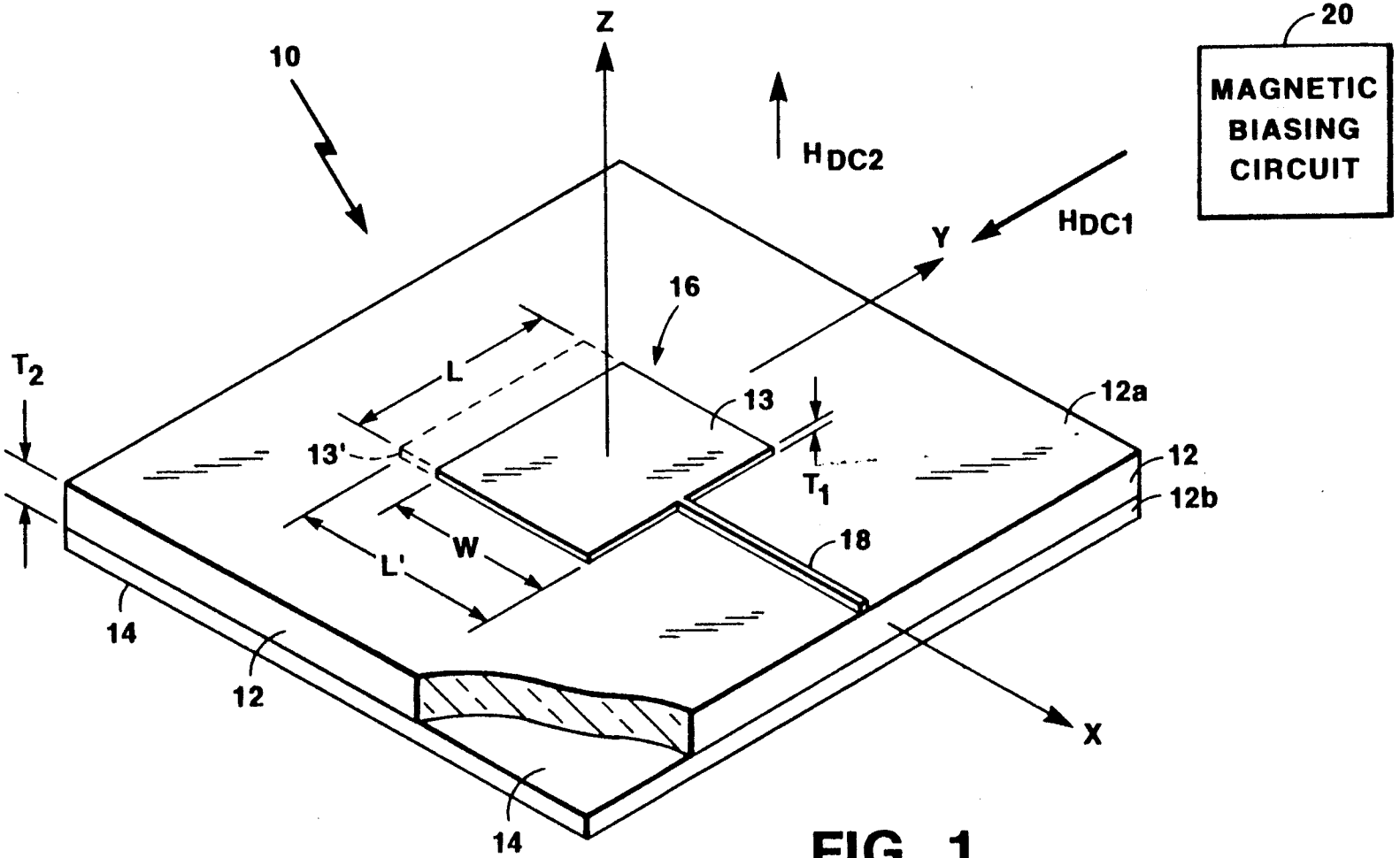
FIG. 1 is a perspective view of a microstrip antenna disposed over a ferrite substrate.

Referring now to FIG. 1, a ferrite microstrip antenna 10 includes a ferrite loaded substrate 12 having first and second opposing surfaces 12*a*, 12*b* and a magnetization $M_s$. Portions of the substrate 12 have here been removed to reveal a ground plane conductor 14 disposed over the surface 12*b*. A strip conductor 13 having a length L and a width W and thickness $T_1$ is disposed over the first surface 12*a* of the substrate 12 to provide a radiating element 16. Strip conductor 13 may be provided having a rectangular shape with a length l and width w or alternatively strip conductor 13 may be provided having a square shape 13 with sides having equal lengths l and l'. The substrate 12 is provided as a ferrite loaded substrate having a thickness $T_2$ and may include ferrites of the spinel or hexagonal type. A radio frequency (RF) feed line 18, here provided as a strip conductor disposed on the first surface 12*a* of the substrate 12, is coupled to a first side of the radiating element 16. Those of ordinary skill in the art will recognize of course that other feed circuits, such as probe feeds, or capacitive feed circuits may also be used to couple RF energy to and from the radiating element 16.

Figure 1A:
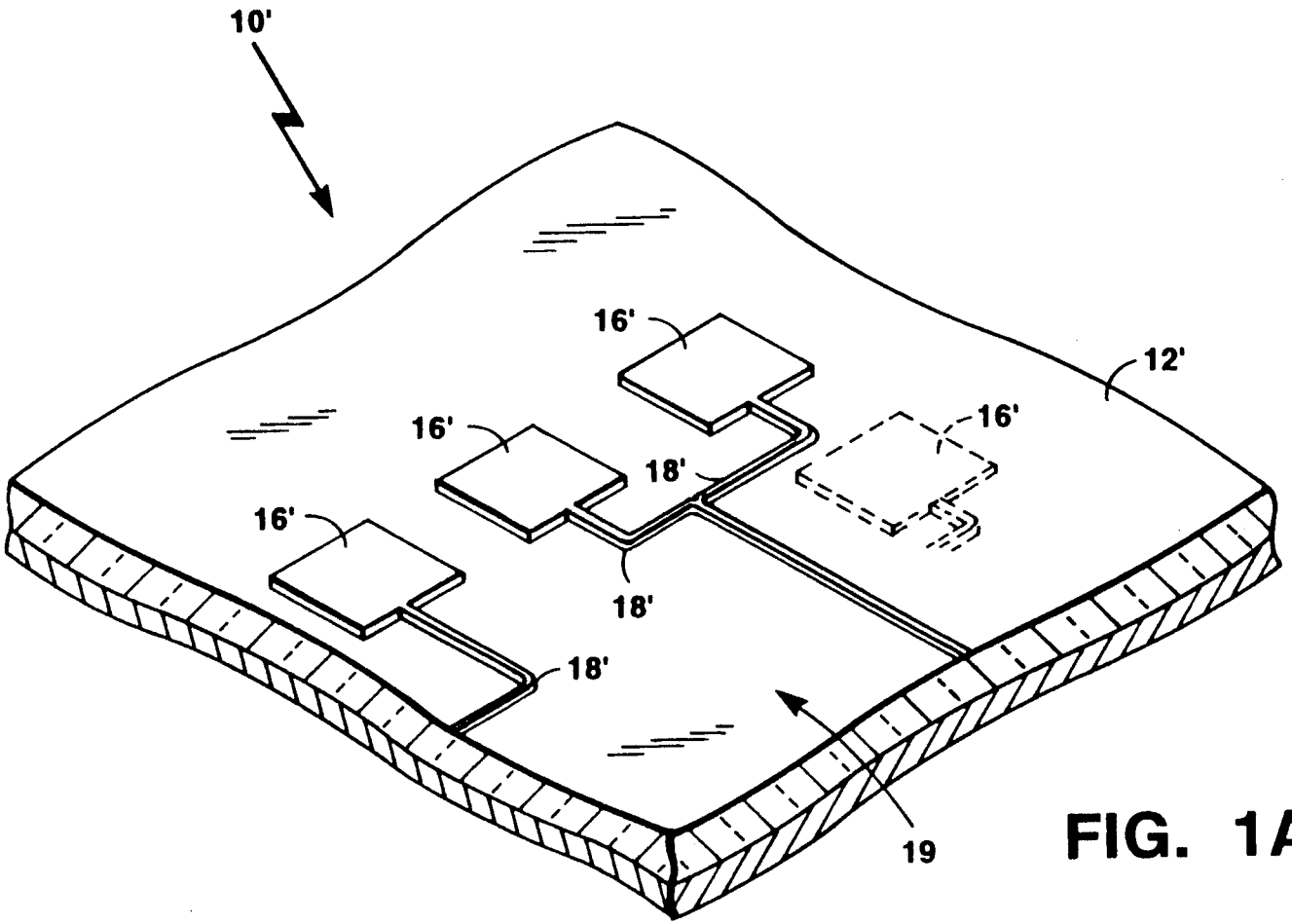
FIG. 1A is a perspective view of a microstrip antenna array disposed over a ferrite substrate.

Referring briefly to FIG. 1A, a portion of an array antenna 10' includes a plurality of like radiating elements 16' disposed over a substrate 12'. Each of the radiating elements may be similar to the radiating element 16 of FIG. 1. A plurality of feed lines 18' are disposed over the substrate 12' to provide an RF feed circuit 19. Each of the feed lines 18' are coupled to respective ones of the radiating elements 16'.

Referring again to FIG. a DC magnetic biasing field circuit 20 is disposed about the substrate 12 to provide a directed DC magnetic field $H_{DC}$ to the antenna 10. In one embodiment, a DC magnetic field $H_{DC1}$ is provided having a direction along a plane parallel to a plane in which the ferrite substrate 12 is disposed (i.e., here the x-y plane) and perpendicular to the feed line 18. In another embodiment, a DC magnetic field $H_{DC2}$ may be applied in a direction normal (i.e., here the z direction) to the strip conductor 16. To provide the antenna 10 having circular polarization radiation characteristics, two linear orthogonal antenna modes having a phase difference of substantially 90 degrees should be supported by the radiating element 16. To provide such a relationship the two dipoles of the DC magnetic biasing field $H_{DC}$ should be substantially 90° out of phase. To provide this condition, the dimensions L and W of the strip conductor, the magnetization $M_s$ of the ferrite substrate 12 and the strength of the DC magnetic field $H_{DC}$ may be empirically selected to provide the antenna 10 having circular polarization radiation characteristics.

For example, with the ferrite substrate having a thickness of typically of about 1 millimeter and a relative dielectric constant in the range of 12 to 14, the strength of the DC magnetic field may generally be in the range of 2–5 thousand Oersteds and the value of $4\pi M_s$ may typically be about 1,000 Gauss. For operation at a predetermined frequency, those of skill in the art may use empirical techniques to select particular values of the above quantities to provide an antenna having desired characteristics.

Figure 2:
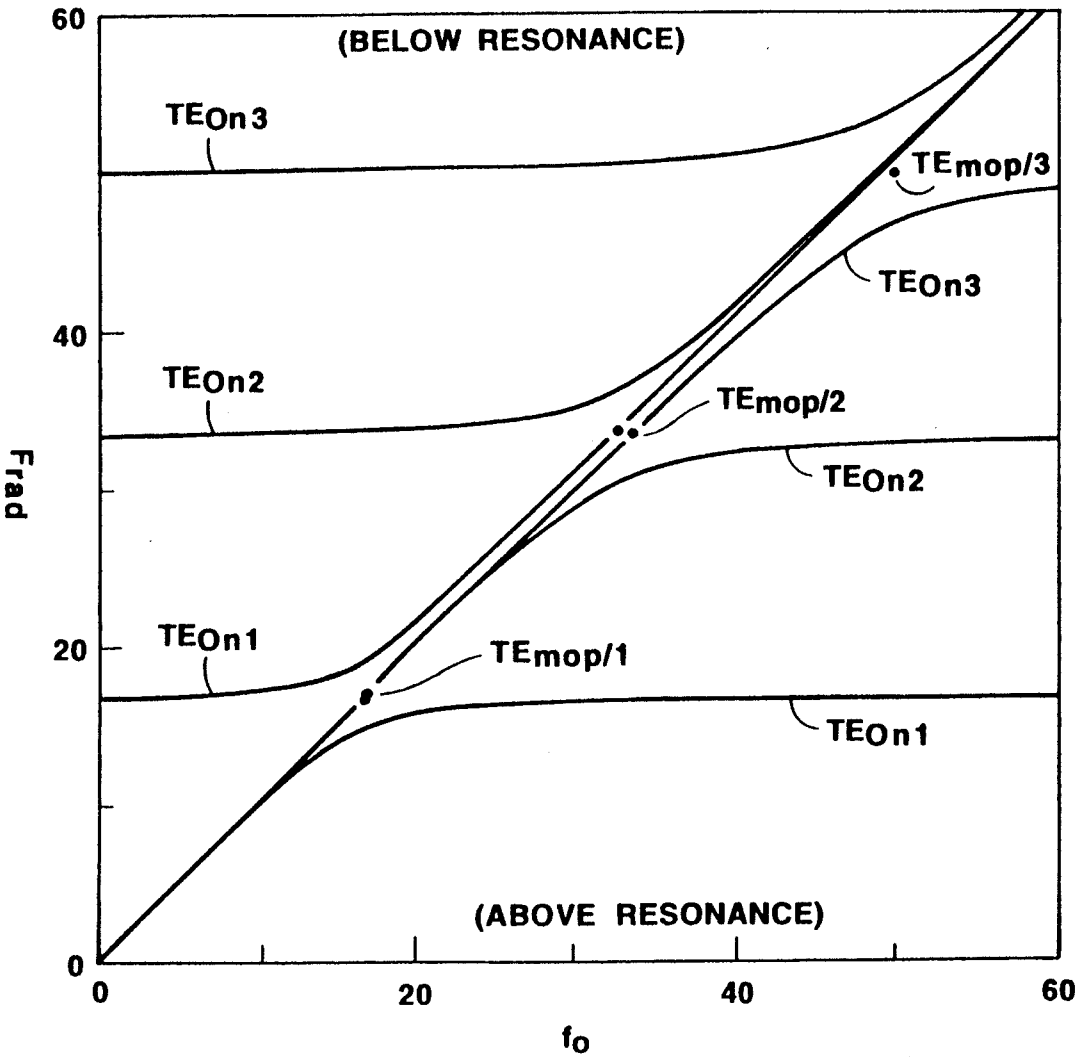
FIG. 2 is a plot of the radiated frequency $F_{RAD}$ in normalized units vs. magnetic field strength in normalized units of a circularly polarized microstrip antenna.

Referring now to FIG. 2, a plot of the resonant frequencies of the normal modes of a ferrite microstrip antenna, which may be of the type shown in FIG. 1 for example, as a function of normalized DC magnetic field strength is shown. The vertical axis of the plot labeled $F_{RAD}$ corresponds to the normalized radiated frequency of the antenna and may be computed by equation 1:

$$F_{RAD}=f_{real}/(4\pi M_s\gamma) \qquad \text{Equation 1}$$

in which $f_{real}$ corresponds to the actual antenna frequency, $M_s$ corresponds to the value of the saturation magnetization of the ferrite material and $\gamma$ corresponds to the gyromagnetic ratio of the ferrite.

The horizontal axis of the plot labeled $f_0$ corresponds to the normalized magnetic field strength and may be computed by equation 2:

$$f_0=H_0/(4\pi M_s) \qquad \text{Equation 2}$$

in which $H_0$ corresponds to the magnetic field value, and $M_s$ corresponds to the value of the saturation magnetization of the ferrite substrate.

In the plot, the curves corresponding to the transverse antenna modes are designated $TE_{onp}$ where p=1, 2, 3, etc., and the curves corresponding to the longitudinal antenna modes are designated $TE_{mop/p}$, where p'=1, 2, 3, etc. The values in the plot correspond to values computed for an antenna having a substrate thickness $T_2$ of 0.030 inch (30 mils.) and the strip conductor 16 is provided having a square shape (i.e. distance W equals distance L).

Here a transverse TE mode is defined to have no spatial variations in the direction of the DC magnetic field and a longitudinal TE mode is defined as having no spatial variations in a direction normal to the DC magnetic field. Thus, the radiation polarizations for the two modes are orthogonal.

The transverse antenna modes may be computed by modelling the microstrip antenna as a cavity as is generally known. However, rather than applying the conventional boundary conditions at the magnetic walls, the boundary conditions are modified such that the Poynting vector is required to vanish at the magnetic wall. This is in contrast to the magnetic wall boundary conditions which are applied in the conventional approach.

The longitudinal antenna modes may be computed from the equations 3–5 below.

$$\sqrt{\mu_e^{(+)}}\,\alpha_1=\sqrt{\mu_e^{(-)}}\,\beta_1 \qquad \text{Equation 3}$$

$$\sqrt{\mu_e^{(+)}}\,\alpha_2=\sqrt{\mu_e^{(-)}}\,\beta_2 \qquad \text{Equation 3A}$$

Equation 3 describes the conditions required to provide matched phases of the two orthogonal modes at the boundaries. In equation 3 $\mu_e^{(+)}$ corresponds to the effective permeability for a positive (+) sense of rotation, and $\mu_e^{(-)}$ corresponds to the effective permeability for a negative (−) sense of rotation, $\alpha_1$–$\alpha_3$ correspond to directional cosines for the (+) mode and $\beta_1$–$\beta_3$ correspond to directional cosines for the (−) mode and may be provided by equations 4 and 5 below:

$$\alpha_3=p\pi/dk_o \qquad \text{Equation 4}$$

$$\beta_3=p'\pi/dk_o \qquad \text{Equation 4A}$$

$$\alpha_1^2+\alpha_2^2+\alpha_3^2=1 \qquad \text{Equation 5}$$

$$\beta_1^2+\beta_2^2+\beta_3^2=1 \qquad \text{Equation 5A}$$

In equations 4 and 4A, p and p' each correspond to a mode number for the (+) and (−) modes respectively, d corresponds to substrate thickness, and $k_0$ corresponds to the wave number.

Equations 4–5A together with the equations 6 and 6A below may be used to uniquely solve the dispersion relations for the coupled modes.

$$\mu_e = k^2/k_o^2 \qquad \text{Equation 6}$$

$$= 1 + \frac{2\alpha_2^2\omega_m}{(1+\alpha_1^2)\omega_o + (1-\alpha_1^2)\omega_m \mp [(1-\alpha_1^2)^2(\omega_o+\omega_m)^2 + 4\alpha_1^2\omega^2]^{\frac{1}{2}}} \qquad \text{Equation 6A}$$

In equation 6A $\omega_o = -\gamma M_o Hin$ and $\omega_m = -\gamma\beta_o M_s$ where $H_m$ corresponds to the value of the internal DC magnetic field. It should be noted that for given values of $k_1$ and $k_2$, a propagating mode may be found at a frequency $\omega$ only if $\omega_o$ is selected at particular discrete values depending on values of p and p'.

From FIG. 2 it may be seen that the transverse TE modes form continuous spectra having values which may be selected according to the strength of the DC magnetic biasing field $H_{DC}$. On the other hand, the longitudinal TE modes are discrete modes which exist only at fixed values of the biasing field and indicated in FIG. 2 by reference designations $TE_{mop/1}-TE_{mop/3}$. Thus, the transverse TE modes may be tuned to the same frequency as a particular one of the longitudinal TE modes.

When such tuning is achieved, that is when the strip conductor dimensions L, W, $T_1$, the substrate thickness $T_1$, the ferrite magnetization $M_s$ and the direction and strength of the DC magnetic field $H_{DC}$ are selected such that the transverse and longitudinal TE modes exist simultaneously at substantially the same frequency, the polarizations of the radiation patterns for the two modes are spatially perpendicular. Furthermore, by selecting the DC magnetic biasing field direction and strength, the ferrite saturation magnetization $M_s$ and other ferrite characteristics, the phase difference between the two orthogonal antenna modes may be selected to be 90 degrees. Such selections may be made empirically. Thus, the antenna may support circularly polarized electromagnetic radiation in the frequency range where the transverse and longitudinal TE modes are simultaneously operational.

Figure 3A:
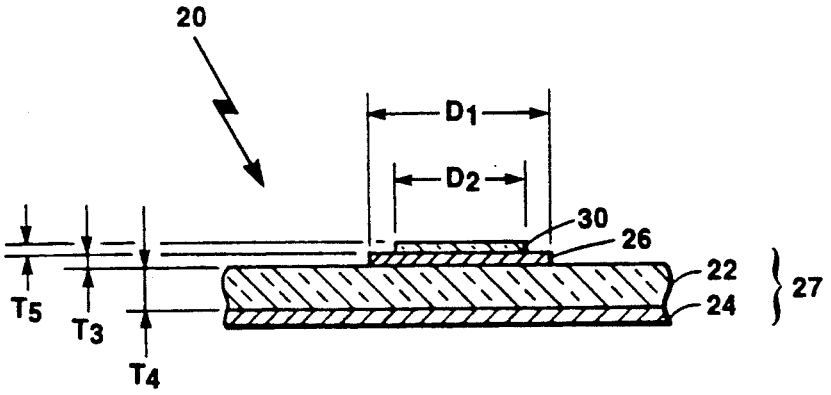
FIG. 3A is a cross sectional view of the microstrip antenna of FIG. 3 taken across lines 3A—3A.
Figure 3:
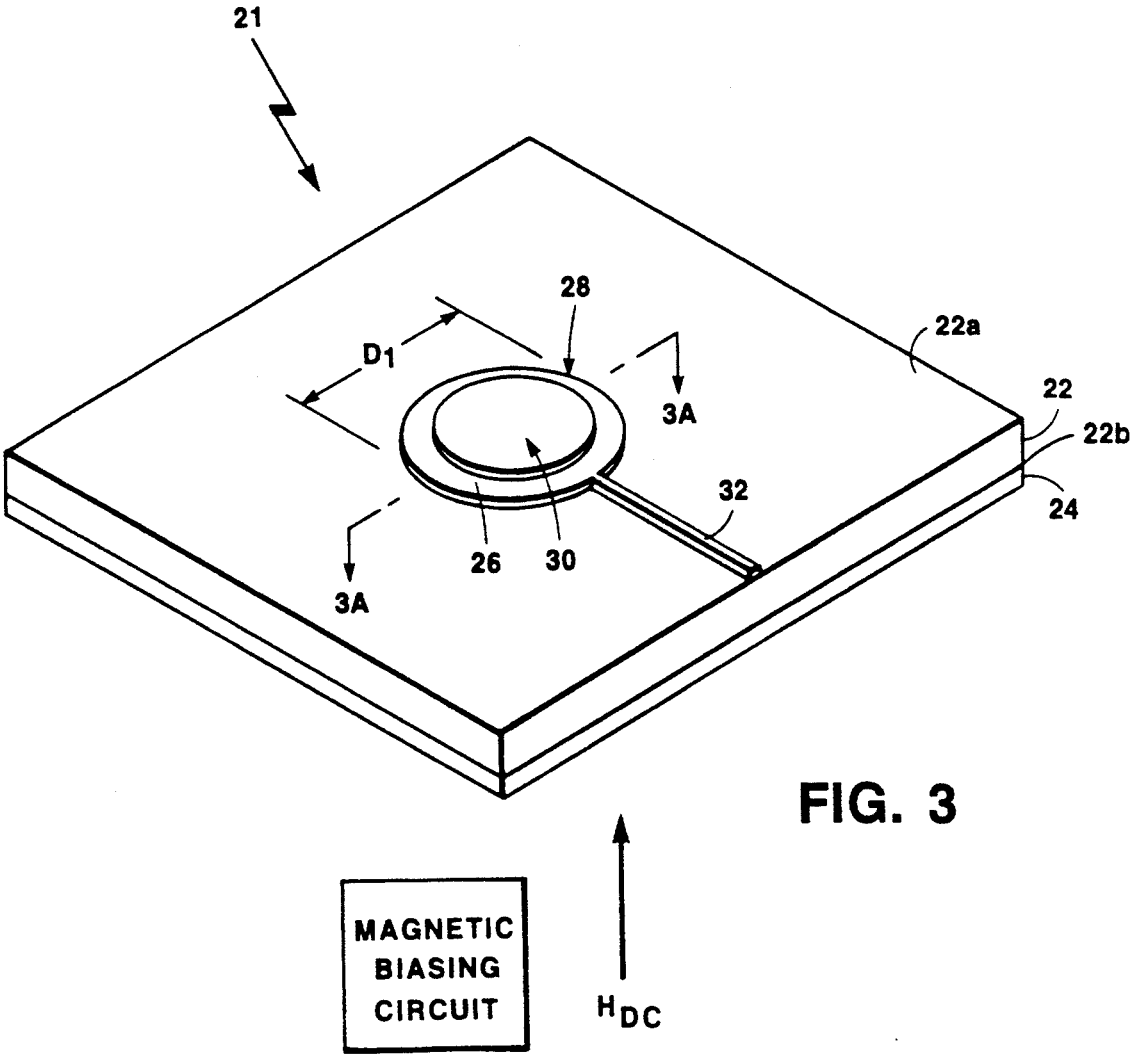
FIG. 3 is a perspective view of a microstrip antenna.

Referring now to FIGS. 3 and 3A in which like elements are provided having like reference designations, a microstrip antenna 21 includes a ferrite loaded substrate 22 having first and second opposing surfaces 22a, 22b and a ground plane conductor 24 disposed over the surface 22b. A strip conductor 26, here having a thickness $T_3$ (FIG. 3A) and a circular shape with diameter $D_1$ (FIG. 3A) is disposed over the substrate surface 12a to provide a radiating element 28. Those of ordinary skill in the art will recognize of course that although the strip conductor 26 is here provided having a circular shape, the strip conductor 26 may be provided having any shape including but not limited to rectangular or annular shapes.

The substrate 22 is provided as a ferrite loaded substrate having a permeability $\mu_1$, a thickness $T_4$ (FIG. 3A) and may include ferrites of the spinel or hexagonal type. Such ferrites may be provided, for example, as the types manufactured by Trans-Tech Inc., Adanstown, Md. A magnesium ferrite substrate identified as Trans-Tech part number TTI-1000 or an yttrium iron garnet (YIG) substrate identified as Trans-Tech part number T-1010 having a predetermined thickness may be used.

Disposed over the radiating element 28 is a second ferrite substrate 30 which may have a permeability $\mu_2$ and a typical thickness $T_5$ (FIG. 3A). For antennas operating in the microwave and millimeter wave frequency ranges the ferrite substrate 30 may be provided having a thickness of about 1 millimeter for example and may be selected according to a variety of factors including but not limited to the permeability $\mu_1$ and thickness $T_4$ of the ferrite substrate 22, the diameter $D_1$ and thickness $T_3$ of the strip conductor 26, and the strength of an applied DC magnetic field $H_{DC}$.

A radio frequency (RF) feed line 32 is disposed on the first surface 12a of the substrate 12 and coupled to a first side of the radiating element 28. It should be noted that although here only one radiating element is shown, those of ordinary skill in the art will recognize that the radiating element 28 may be one of a plurality of like radiating elements disposed to provide an array antenna similar to the antenna array 10' shown in FIG. 1A Similarly, the feed line 32 may be one of a plurality of feed lines which provide an RF feed circuit, each of such feed lines being coupled to respective ones of the radiating elements.

A DC magnetic biasing field circuit 34 is disposed about the substrate 22 and provides a DC magnetic field having a predetermined field strength directed in a plane normal to a surface of the strip conductor 26.

Here the DC magnetic field $H_{DC}$ is selected having a strength such that the ferromagnetic resonance (FMR) of the first ferrite loaded substrate 22 is tuned away from the resonant frequency of the substrate 22. Thus the substrate 22 will not absorb the maximum amount of RF energy provided thereto.

The FMR of the second ferrite substrate 30, however, is selected such that the FMR of the substrate is substantially centered within the operating frequency band of the antenna 20. Since the FMR of the substrate 22 is tuned away from the operating frequency band of interest, the antenna 20 radiates electromagnetic energy unimpeded at the desired frequency.

When RF energy having a frequency within the operating frequency band of the antenna 20 and originating from an external RF source is incident upon the antenna 20, the second substrate 30 absorbs such RF energy. Thus, the amount of RF energy which is incident upon the strip conductor 26 is substantially less than the amount of RF energy incident on the ferrite substrate 30. This leads to a concomitant reduction in the amount of energy which is reflected and reradiated from the strip conductor 26 and thus the effective radar cross section (RCS) of the antenna 20 is reduced.

On the other hand, the FMR bandwidth of the ferrite substrate 30 is wider than the bandwidth of the radiating combination 27. Thus the substrate 30 provides the antenna 20 having a wider operating frequency bandwidth.

Having described preferred embodiments of the invention, it will now become apparent to one of skill in the art that other embodiments incorporating their concepts may be used. It is felt, therefore, that these embodiments should not be limited to disclosed embodiments but rather should be limited only by the spirit and scope of the appended claims.

What is claimed is:

1. A microstrip antenna comprising:

a ferrite loaded substrate having first and second opposing surfaces;

a ground plane conductor disposed over the first surface of said substrate;

a strip conductor having a rectangular shape disposed over the second surface of said substrate;

an RF feed circuit disposed on a first one of the first and second surfaces of said substrate and coupled to said first strip conductor; and a DC magnetic field biasing circuit for providing a DC magnetic field to said ferrite substrate wherein the DC magnetic field is provided in a plane parallel to a plane in which the ferrite substrate is disposed and wherein the direction of the DC magnetic field is perpendicular to said RF feed circuit.

2. The microstrip antenna of claim 1 wherein said ferrite substrate includes spinel ferrites.

3. The microstrip antenna of claim 1 wherein said ferrite substrate includes hexagonal ferrites.

4. The microstrip antenna of claim 1 wherein said RF feed circuit is provided as a strip conductor disposed on the second surface of said substrate.

5. The microstrip antenna of claim 1 wherein said ground plane conductor has portions thereof removed to expose said substrate and said RF feed circuit is provided as a strip conductor disposed in the exposed portions of the first surface of said substrate.

6. The microstrip antenna of claim 1 wherein said rectangular shaped strip conductor corresponds to a square shape.

7. The microstrip antenna of claim 1 wherein:

said strip conductor is a first one of a plurality of strip conductors each of said plurality of strip conductors disposed over the second surface of the substrate; and said RF feed circuit is a first one of a plurality of feed circuits each one of said plurality of feed circuits coupled to a corresponding one of said plurality of strip conductors.

8. The microstrip antenna of claim 7 wherein said ferrite substrate includes a spinel ferrite.

9. The microstrip antenna of claim 7 wherein said ferrite substrate includes a hexagonal ferrite.

10. The microstrip antenna array of claim 7 wherein said ground plane conductor has portions thereof removed to expose said substrate and at least one of said plurality of RF feed circuits is provided as a strip conductor disposed on the first surface of said substrate.

11. The microstrip antenna array of claim 7 wherein at least one of said plurality of said RF feed circuits is provided as a strip conductor disposed on the second surface of said ferrites substrate.

12. A microstrip antenna comprising:

a ferrite loaded substrate having first and second opposing surfaces and having a first permeability;

a ground plane conductor disposed over the first surface of said substrate;

a first antenna element disposed over the second surface of said substrate wherein said first antenna element is provided having a shape selected such that said first antenna element is responsive to electromagnetic energy at a first frequency;

an RF feed circuit disposed on a first one of the first and second surfaces of said substrate and coupled to said first antenna element;

a ferrite material disposed over said first antenna element wherein said ferrite material is selected having a second permeability wherein the second permeability is different than the first permeability of said ferrite substrate; and a DC magnetic field biasing circuit for providing a DC magnetic field in a direction normal to said ferrite substrate and said first antenna element.

13. The microstrip antenna of claim 12 wherein said ferrite substrate includes spinel ferrites.

14. The microstrip antenna of claim 12 wherein said ferrite substrate includes hexagonal ferrites.

15. The microstrip antenna of claim 12 wherein said RF feed circuit is provided as a strip conductor disposed on the second surface of said substrate.

16. The microstrip antenna of claim 12 wherein said RF feed circuit is provided as a strip conductor disposed on the first surface of said substrate.

17. The RF antenna of claim 12 wherein:

said first antenna element is a first one of a plurality of antenna elements each of said plurality of antenna elements disposed over the second surface of the substrate, wherein each of said antenna elements radiate electromagnetic energy in response to RF energy fed thereto;

said RF feed circuit is a first one of a plurality of RF feed circuits, each one of said RF feed circuits coupled to one of said plurality of antenna elements.

18. The microstrip antenna array of claim 17 wherein said ferrite substrate includes a spinel ferrite.

19. The microstrip antenna array of claim 17 wherein said ferrite substrate includes a hexagonal ferrite.

20. The microstrip antenna array of claim 17 wherein at least one of said plurality of RF feed circuits is provided as a strip conductor disposed on the second surface of said substrate.

21. The microstrip antenna array of claim 17 wherein at least one of said plurality of RF feed circuits is provided as a strip conductor disposed on the first surface of said ferrite substrate.

* * * * *

UNITED STATES PATENT AND TRADEMARK OFFICE

CERTIFICATE OF CORRECTION

PATENT NO. : 5,327,148

DATED : July 5, 1994

INVENTOR(S) : Hoton How, et al.

It is certified that error appears in the above-indentified patent and that said Letters Patent is hereby corrected as shown below:

Column 3, line 34, "to FIG. a DC" should read --to FIG. 1 a DC--.

Column 4, line 23, "$TE_{mop/p,}$" should read --$TE_{mop/p}$,--.

Column 5, line 12, Equation 6A, on the top line "$2\alpha_2^2\omega_m$" should read --$2\alpha_1^2\omega_m$--.

Column 5, line 17, "and $\omega_m = - \gamma\beta_o M_s$" should read --and $\omega_m = - \gamma\mu_o M_s$--.

Column 7, line 55, "ferrites" should read --ferrite--.

Signed and Sealed this

Twenty-first Day of March, 1995

*Attest:*

Bruce Lehman

BRUCE LEHMAN

*Attesting Officer*

*Commissioner of Patents and Trademarks*